United States Patent [19]

Sarvanne

[11] Patent Number: 4,614,478

[45] Date of Patent: Sep. 30, 1986

[54] PUMP IMPELLER

[75] Inventor: Hannu Sarvanne, Kivivuorenkuja, Finland

[73] Assignee: Oy E. Sarlin AB, Helsinki, Finland

[21] Appl. No.: 738,497

[22] Filed: May 28, 1985

[30] Foreign Application Priority Data

Jun. 6, 1984 [FI] Finland ..... 842264

[51] Int. Cl.[4] ..... F04D 1/04

[52] U.S. Cl. ..... 416/19; 416/186 R; 416/179; 415/213 A

[58] Field of Search ..... 416/179, 144, 19, 186 R, 416/19, 144, 235, 236 R, 187; 415/213 A, 213 B

[56] References Cited

U.S. PATENT DOCUMENTS

| | | | |
|---|---|---|---|
| 1,439,364 | 12/1922 | Hazell | 416/144 X |
| 1,470,607 | 10/1923 | Hazell | 416/19 X |
| 1,754,992 | 4/1930 | Fabrin | 416/144 X |
| 1,934,013 | 11/1933 | Sim | 416/186 R |
| 2,741,992 | 4/1956 | Glazebrook | 416/144 X |
| 2,853,019 | 9/1958 | Thornton | 416/144 X |
| 2,958,293 | 11/1960 | Pray, Jr. | 415/213 A |
| 3,234,887 | 2/1966 | Grosskopf | 416/235 |
| 3,294,026 | 12/1966 | Lobanoff | 415/213 A |
| 3,323,464 | 6/1967 | Benton et al. | 416/235 X |
| 3,384,026 | 5/1968 | Williamson, Jr. | 415/213 A |
| 3,481,531 | 12/1969 | MacArthur et al. | 416/236 R X |
| 3,732,032 | 5/1973 | Daneel | 416/19 X |
| 4,076,179 | 2/1978 | Tsukube | 415/213 A |
| 4,432,693 | 2/1984 | Hackbart | 416/179 |
| 4,530,643 | 7/1985 | Carlsson | 416/19 X |
| 4,575,312 | 3/1986 | Erikson | 416/144 X |

FOREIGN PATENT DOCUMENTS

| | | | |
|---|---|---|---|
| 156379 | 11/1951 | Australia | 416/144 |
| 830548 | 2/1952 | Fed. Rep. of Germany | 416/186 R |
| 1042384 | 10/1958 | Fed. Rep. of Germany | 416/186 R |
| 491020 | 2/1954 | Italy | 416/144 |
| 189936 | 6/1937 | Switzerland | 416/144 |
| 680070 | 10/1952 | United Kingdom | 416/186 R |
| 567852 | 10/1977 | U.S.S.R. | 416/186 R |

*Primary Examiner*—Everette A. Powell, Jr.
*Attorney, Agent, or Firm*—Browdy and Neimark

[57] ABSTRACT

An impeller in a pump, in particular a sewage pump, the passage of which is required to have a given transmission capacity for transmitting the impurities present in the sewage water. When small volumetric flows are being pumped at great delivery lift, it would be advantageous, with a view to achieving good efficiency, to make the passage narrower than the inlet aperture, but up to date it has not been possible to do this without impairing the transmission capacity. In the impeller of the invention, this has been solved in that for achieving sufficient transmission capacity one wider point has been provided in the passage, located between the inlet and outlet margins of the impeller blade.

4 Claims, 3 Drawing Figures

PUMP IMPELLER

BACKGROUND OF THE INVENTION

The present invention concerns the impeller of a pump, in particular a sewage pump impeller, the passage of which is required to have a given transmission capacity for passing through solid impurities present in the sewage water.

Such needs are frequently encountered in sewage pumps in which a small volumetric flow has to be pumped at great delivery lift. In order to achieve good efficiency of the pump and a delivery life/volymetric flow graph of advantageous shape, the passage of the pump impeller should be narrow in the flow-technological sense. As was mentioned at the beginning, the sewage pump should have sufficient transmission capacity because the sewage water also contains solid impurities in abundance, such as rags, shredded plastics, etc. In Finland and in most other countries, sewage pumps are required to have at least 80 mm transmission capacity. This is understood to mean that the pump must pass through a spherical body with diameter 80 mm. Therefore, it has not been possible to reduce the size of the passage so far. Moreover, the width of the passage has up to date been constant over the entire periphery.

SUMMARY OF THE INVENTION

The object of the present invention is to provide a sewage pump impeller in which the cross-section area of the passage is mainly smaller than the transmission capacity, but in which sufficient transmission capacity still remains. The invention is therefore characterized in that, for achieving sufficient transmission capacity, one wider point has been formed in the passage, located between the inlet and outlet margins of the impeller vane. The predominant part of th passage is thus narrower than the widest point, and this improves the efficiency of the pump when pumping small volymetric flows at great delivery lift. Thanks to the wide spot, the transmission capacity of the pump is however preserved. An advantageous embodiment of the invention is characterized in that the wider point of the impeller has been produced by providing in the flanges of the impeller, grooves having a cross section of substantially circular segment shape. A concavity of this kind is easy to make, and no harmful angles are thereby produced where impurities could be caught.

BRIEF DESCRIPTION OF THE DRAWINGS

In the following invention is described more in detail, referring to the drawings attached, wherein.

DESCRIPTION OF THE PREFERRED EMBODIMENT

Figure 1:
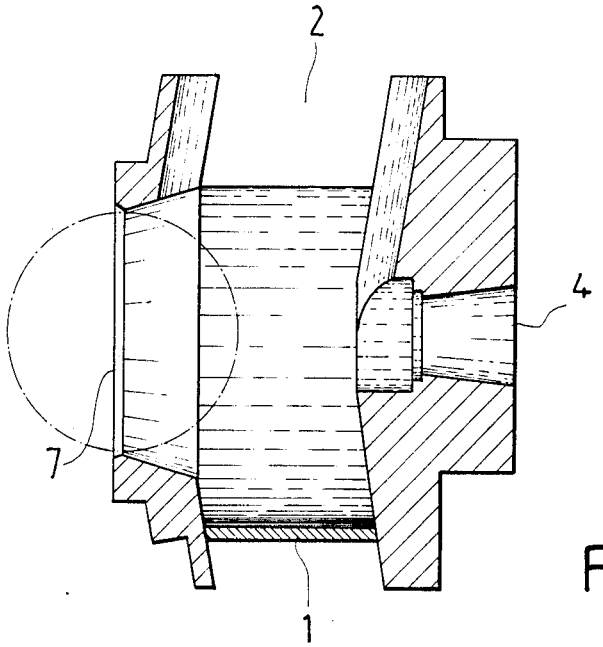
FIG. 1 presents a section along the line 1—1 of FIG. 2.
Figure 2:
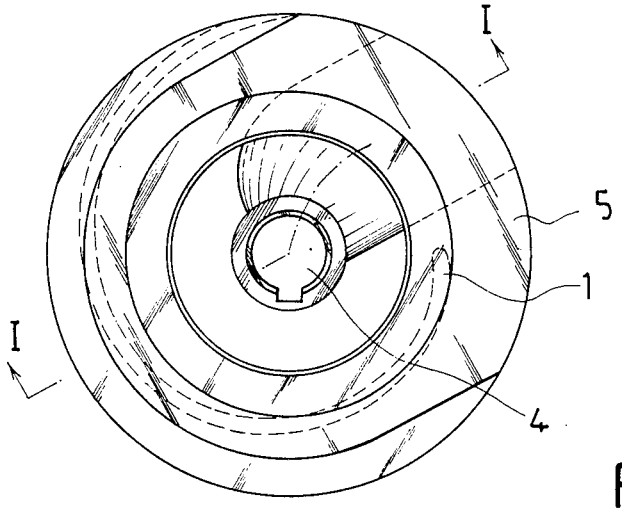
FIG. 2 presents the impeller of the invention viewed from the shaft end.
Figure 3:
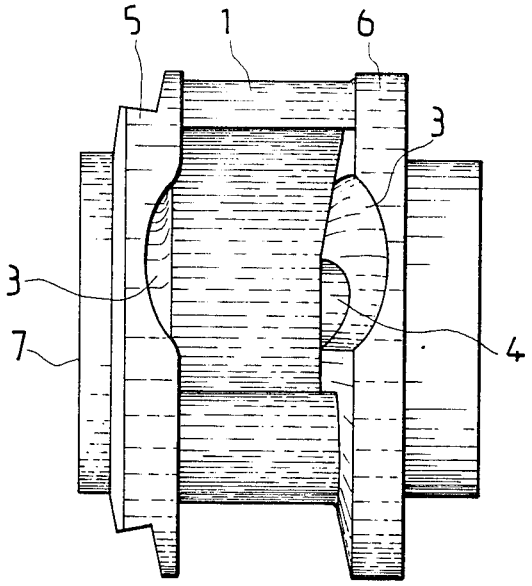
FIG. 3 presents axonometrically the impeller of the invention.

Impellers of this kind are as a rule used in centrifugal pumps with which sewage water is pumped. When the pump is in operation, the impeller rotates with the aid of a shaft 4 at high speed and draws water through the inlet aperture 7 into the vane section of the impeller, consisting in the present instance of one vane 1. The inlet aperture is circular in shape and its diameter at least equals the minimum transmission capacity of the sewage pump. In Finland and in most other countries, this is 80 mm, as mentioned before. The vane 1 pushes water out from the impeller through the passage 2. With a view to improving the efficiency and the delivery lift/volumetric flow graph, the width of the passage has been made smaller than the inlet aperture 7. However, for maintaining sufficient transmission capacity, a wider point has been made in the passage, consisting in the present instance of grooves 3 made in the flanges 5, 6. It is, however, essential in the impeller of the invention that the predominat part of the passage is narrower than the widest point. It is seen in the figures that the groove made in the flange 6 extends all the way to the shaft 4, which is natural in order that the wide point might be wide enough over the whole length of the passage.

It is obvious to a person skilled in the art that the invention is not confined to the embodiment example presented in the foregoing and that it may be modified within the scope of the claims to follow.

I claim:

1. In a pump for transmission of solid and liquid sewage, an impeller comprising:

a rotatable body having an axis of rotation and including a first flange portion of a predetermined radius including means for coupling said body with a rotatable driving shaft, a second flange portion of a predetermined radius spaced axially from said first flange portion, said first and second flange portions defining therebetween a passage having an axially extensive width, and vane means, disposed in said passage, for inducing a flow of the sewage through inlet means into said passage and then discharging the induced sewage from said passage when said body is rotated, said rotatable body further including grooves, of a predetermined constant, maximum width greater than the width of said passage, located in facing surfaces of said first and second flange portions, and extending normal to said axis from said vane means radially outwardly to the radial outermost extent of said flanges, for transmitting, during discharge of the induced sewage from said passage, sewage solids of a width greater than the width of said passage.

2. An impeller for use in a pump, particularly a sewage pump, including an axis of rotation, an inlet for admitting sewage to the impeller in a first direction, an outlet for discharging the sewage, a passage within the impeller having a predetermined capacity for transmitting solid impurities in the sewage from the inlet to the outlet, and at least one vane in the passage disposed generally normal to the first direction and defining with the passage an inlet region adjacent the inlet and and outlet region adjacent the outlet, said impeller comprising:

opposing, radially extensive walls defining said passage, said passage having a width of a first dimension extending in said first direction, and said vane having the same width as said passage at said inlet region, and grooved means in said opposing walls, having a width of a second dimension larger than said first dimension and extending in a direction normal to said first direction continuously from said inlet to said outlet, for transmitting from said inlet region to said outlet region solid impurities of a size larger than said first dimension.

3. The improvement of claim 2, wherein said grooved transmitting means comprise complementarily configured recesses.

4. The improvement of claim 3, wherein said recesses each have a cross-section in the shape of a segment of a circle.

* * * * *